US007152681B2

(12) United States Patent
Olsen et al.

(10) Patent No.: US 7,152,681 B2
(45) Date of Patent: Dec. 26, 2006

(54) METHOD AND ARRANGEMENT FOR TREATMENT OF FLUID

(75) Inventors: Geir Inge Olsen, Oslo (NO); Gunder Homstvedt, Oslo (NO)

(73) Assignee: Aker Kvaerner Subsea AS, Lysaker (NO)

( * ) Notice: Subject to any disclaimer, the term of this patent is extended or adjusted under 35 U.S.C. 154(b) by 152 days.

(21) Appl. No.: 10/399,769

(22) PCT Filed: Oct. 22, 2001

(86) PCT No.: PCT/NO01/00421

§ 371 (c)(1),
(2), (4) Date: Apr. 21, 2003

(87) PCT Pub. No.: WO02/33218

PCT Pub. Date: Apr. 25, 2002

(65) Prior Publication Data

US 2004/0069494 A1 Apr. 15, 2004

(30) Foreign Application Priority Data

Oct. 20, 2000 (NO) ..... 20005318

(51) Int. Cl.
*E21B 33/76* (2006.01)

(52) U.S. Cl. ..... 166/357; 166/368; 166/268; 166/372

(58) Field of Classification Search ..... 166/268, 166/269, 263, 305.1, 369, 370, 371, 372, 166/373, 381, 386, 90.1, 351, 360, 368, 357
See application file for complete search history.

(56) References Cited

U.S. PATENT DOCUMENTS

| | | | | |
|---|---|---|---|---|
| 4,189,923 | A * | 2/1980 | Berg | 60/641.5 |
| 4,824,447 | A * | 4/1989 | Goldsberry | 96/9 |
| 5,339,905 | A | 8/1994 | Dowker | |
| 5,431,228 | A * | 7/1995 | Weingarten et al. | 166/357 |
| 5,450,901 | A * | 9/1995 | Ellwood | 166/266 |
| 5,501,279 | A | 3/1996 | Garg et al. | |
| 5,794,697 | A * | 8/1998 | Wolflick et al. | 166/265 |
| 5,988,275 | A * | 11/1999 | Brady et al. | 166/105.5 |
| 6,048,462 | A * | 4/2000 | Daskopoulos et al. | 210/668 |
| 6,092,599 | A | 7/2000 | Berry et al. | |
| 6,189,614 | B1 * | 2/2001 | Brady et al. | 166/266 |
| 6,336,504 | B1 * | 1/2002 | Alhanati et al. | 166/265 |
| 6,547,005 | B1 * | 4/2003 | Haheim | 166/265 |
| 2003/0019633 | A1 * | 1/2003 | Podio et al. | 166/370 |

FOREIGN PATENT DOCUMENTS

| | | |
|---|---|---|
| EP | 1041243 A2 | 10/2000 |
| GB | 2326895 A | 1/1999 |
| GB | 2346936 A | 8/2000 |
| NO | 304388 B1 | 2/1998 |
| WO | WO 98/41304 | 9/1998 |

* cited by examiner

*Primary Examiner*—William Neuder
*Assistant Examiner*—Nicole A. Coy
(74) *Attorney, Agent, or Firm*—Maine & Asmus

(57) ABSTRACT

A method utilizes the energy of water that flows out from a high-pressure reservoir. Water and hydrocarbons are separated in a down-hole separator and are brought separately to the seabed. In a first aspect the energy of the water is utilized to inject the water into an underground formation with a lower pressure. In a second aspect the energy is utilized to drive a turbine which in turn is driving a pump for pressurizing hydrocarbons. The invention utilizes a method and an arrangement to control the separator by control valves on the well head for each phase.

30 Claims, 11 Drawing Sheets

METHOD AND ARRANGEMENT FOR TREATMENT OF FLUID

RELATED APPLICATIONS

The application is a National Stage of International Application No. PCT/NO01/00421, file Oct. 22, 2001, which published in the English language and is an international filing of Norway Application No. 20005318, filed on Oct. 20, 2000. Priority is claimed.

FIELD OF THE INVENTION

The present invention relates to downhole separation of hydrocarbons and water followed by discrete (separate) transportation of the fluids to a subsea wellhead for further processing, especially avoiding use of downhole rotating machinery as far as possible. The invention relates in a first aspect to utilisation of the pressure energy in the water phase for injection into an underground formation. In a second aspect the invention relates to utilisation of the pressure energy of the water phase or the hydrocarbon phase to power equipment on the seabed. It relates in a third aspect to a method of controlling the downhole separator. In a fourth aspect it relates to a method and an arrangement of supplying gas for lifting the produced water to the wellhead.

BACKGROUND OF THE INVENTION

Capital and operational expenses of subsea developments, especially in deep waters, are high. Simple and reliable equipment is therefore important. Well maintenance costs are high due to the high intervention cost. Reliability of all this equipment is therefore a key word for success.

Flow assurance is of utmost importance for field economics. Water in the hydrocarbon stream is one of the frequent causes of flow related problems. Removing water will reduce possible hydrate formation and allow using flow lines with smaller diameter at reduced cost. Power needed for pressure boosting will be reduced due to the lower bulk flow and density.

Water is almost always present in the rock formation where hydrocarbons are found. The reservoir will normally produce an increasing portion of water with increase time. Water generates several problems for the oil and gas production process. It influences the specific gravity of the crude flow by dead weight. It transports the elements that generate scaling in the flow path. It forms the basis for hydrate formation, and it increases the capacity requirements for flowlines and topside separation units. Hence, if water could be removed from the well flow even before it reaches the wellhead, several problems can be avoided. Furthermore, oil and gas production can be enhanced and oil accumulation can be increased since increased lift can be obtained with removal of the produced water fraction.

A downhole hydrocyclone based separation system can be applied for both vertically and horizontally drilled wells, and may be installed in any position. Use of liquid-liquid (oil-water) cyclone separation is only appropriate with higher water-cuts (typical with water continuous wellfluid). Water suitable for re-injection to the reservoir can be provided by such a system. Cyclones are associated with purifying one phase only, which will be the water-phase in a downhole application. Using a multistage separation cyclone separation system, such as described in pending Norwegian patent application NO 2000 0816 of the same applicant will reduce water entrainment in the oil phase. However, pure oil will normally not be achieved by use of cyclones. Furthermore, energy is taken from the well fluid and is consumed for setting up a centrifugal field within the cyclones, thereby creating a pressure drop.

A downhole gravity separator is associated with a well specially designed for its application. A horizontal or a slightly deviated section of the well will provide sufficient retention time and a stratified flow regime, required for oil and water to separate due to density difference.

Separation of water from the hydrocarbon flow is therefore important. Such separation can be done at the seafloor and downhole. The separation process is however proven to be much more efficient downhole than at the seafloor. Such separation is also done more efficiently in each well bore than on the commingled well fluid from several wells. Downhole removal of water from the hydrocarbon flow, giving a less dense column, will result in a higher pressure available at the seabed. This will result in less need for pressure boosting for flow line transportation. Separation should therefore, if well conditions permit, rather be arranged downhole than subsea.

In copending Norwegian Patent Application No. 2000 1446 a system is described, in which a downhole turbine/pump hydraulic converter is used to inject the water into the formation to increase the pressure in the formation and thereby achieve more hydrocarbon output from the reservoir. This system is specially suitable for application in low to medium pressure wells, in which the water injection can increase the output.

However, in high pressure wells it is usually not of major benefit to inject water. Thus, a different system is needed for such wells. Since all rotating machinery (pumps and compressors) are among the most unreliable pieces of equipment of field developments, it is desirable to avoid such machinery downhole, where access and monitoring is difficult. In designing a system for exploitation of high pressure well it is therefor an object to avoid downhole rotating machinery as far as possible.

The alternative, locating the equipment topside, i.e. on the platform, is, as mentioned above, not a very good solution either. This calls for a subsea location of at least a part of such equipment.

However, downhole separation has major benefits over topside or subsea separation. This is due to the fact that the pressure gradient of hydrocarbons is steeper than the pressure gradient of the water. Downhole separation of the reservoir fluid thus gives a higher pressure of the hydrocarbons at the seabed than the total reservior fluid. A higher pressure means that the hydrocarbons can be transported over a further distance without additional pressure boosting or with less pressure boosting, than in the case of separation at the seabed or topside.

BRIEF SUMMARY OF THE INVENTION

The present invention is therefore allowing various combinations of a downhole separation system with subsea location of all rotating machinery. If artificial lift would be necessary, in particular late in the well's lifetime, a gas lift system should be applied rather than a downhole pump.

Gas lift of the mixed well flow path is standard practice. In the well known method gas is injected in the well flow at some distance below the well head, resulting in a reduction of the specific gravity of the combined gas and well fluid. This further results in a reduction of the inflow pressure in the well bore and an increased flow rate. As the pressure is reduced higher up in the production tubing, further increasing the gas volume, the gravity is even more reduced, helping the flow substantially. The gas is normally injected into the annulus through a pressure controlled inlet valve, into the production tubing at a suitable elevation. The elevation is mainly depending on available gas pressure.

However, it has not been suggested until now to use gas for artificial lift of the water. According to an aspect of the present invention this is one way of ensuring a sufficient pressure of the water at the seabed, while avoiding pumps or the like downhole.

The pressure drop of well fluid during flow from the bottom hole to the seabed is determined by the following equation:

$$\Delta p=\rho_{mix}g\Delta h+k\rho_{mix}Q_{mix}^2 \quad (1),$$

wherein Δp is the pressure drop, $\rho_{mix}$ is the density of the combined phases of the well fluid, Δh is the depth from the seabed to the bottom hole, k is a constant (depending on inter alia the physical structures of the flow line and $Q_{mix}$ is the flow rate.

The first term ($\rho_{mix}g\Delta h$) is the static part of the pressure drop, while the second term ($k\rho_{mix}Q_{mix}^2$) is the dynamic part of the pressure drop.

The density of the well fluid is determined by the following equation:

$$\rho_{mix}=(\rho_g Q_g+\rho_o Q_o+\rho_w Q_w)/(Q_g+Q_o+Q_w) \quad (2),$$

wherein $\rho_g$, $\rho_o$ and $\rho_w$ are the densities of gas, oil and water and $Q_g$, $Q_o$ and $Q_w$ are the flow rates of gas, oil and water.

Since the densities of the three phases are increasing in the following order: $\rho_g$, $\rho_o$ and $\rho_w$, a removal of the water from the well fluid will reduce the density of the remaining phases and thereby reduce the pressure loss, i.e. the pressure gradient is steeper. Injection of gas into the water will reduce the density of the combined phases (gas-water) and thereby reduce the pressure loss. However, a limitation on the amount of gas feasible for injection is limited by the second term of equation (1). Since the dynamic pressure drop is increasing by $Q^2$ the injection of gas above a certain amount will (at least in theory) increase the pressure drop. In other words: the use of gas for artificial lift will increase frictional pressure drop since the total volume flow increases with gas being brought back to the host. At long tie-back distances the net effect of using gas lift becomes low when gain in static pressure is reduced by increased dynamic pressure drop. However, downhole gas lift can be accomplished locally at the production area by separating and compressing a suitable rate of gas taken from the well fluid and distributing the gas to the subsea wells for injection. This recycling of gas reduces the amount of gas flowing in the pipeline, compared to supplying gas from the host. The advantage of this can be utilized by increasing the production rate from the wells, reducing pipeline size or increasing capacity by having additional wells producing via the pipeline. In addition to this, gas lift at the riserbase will become more effective with this configuration.

The present invention therefor suggests in one aspect of the invention, applying downhole separation in combination with gas lift of the separated water. As this water is lifted to surface it can be routed to an injection well or discharged to sea. If discharge to sea or a very low pressurized discharge zone is allowed, the energy available in the water flow path can be run through a turbine to typically power a pump or a compressor.

BRIEF DESCRIPTION OF THE DRAWINGS

The invention will now be explained in further detail referring to the accompanying drawings showing exemplifying embodiments for illustration purposes, in which.

DETAILED DESCRIPTION OF THE INVENTION

First FIGS. 5 and 6 will be explained for better understanding of the pressure conditions of a high pressure formation.

Figure 5:
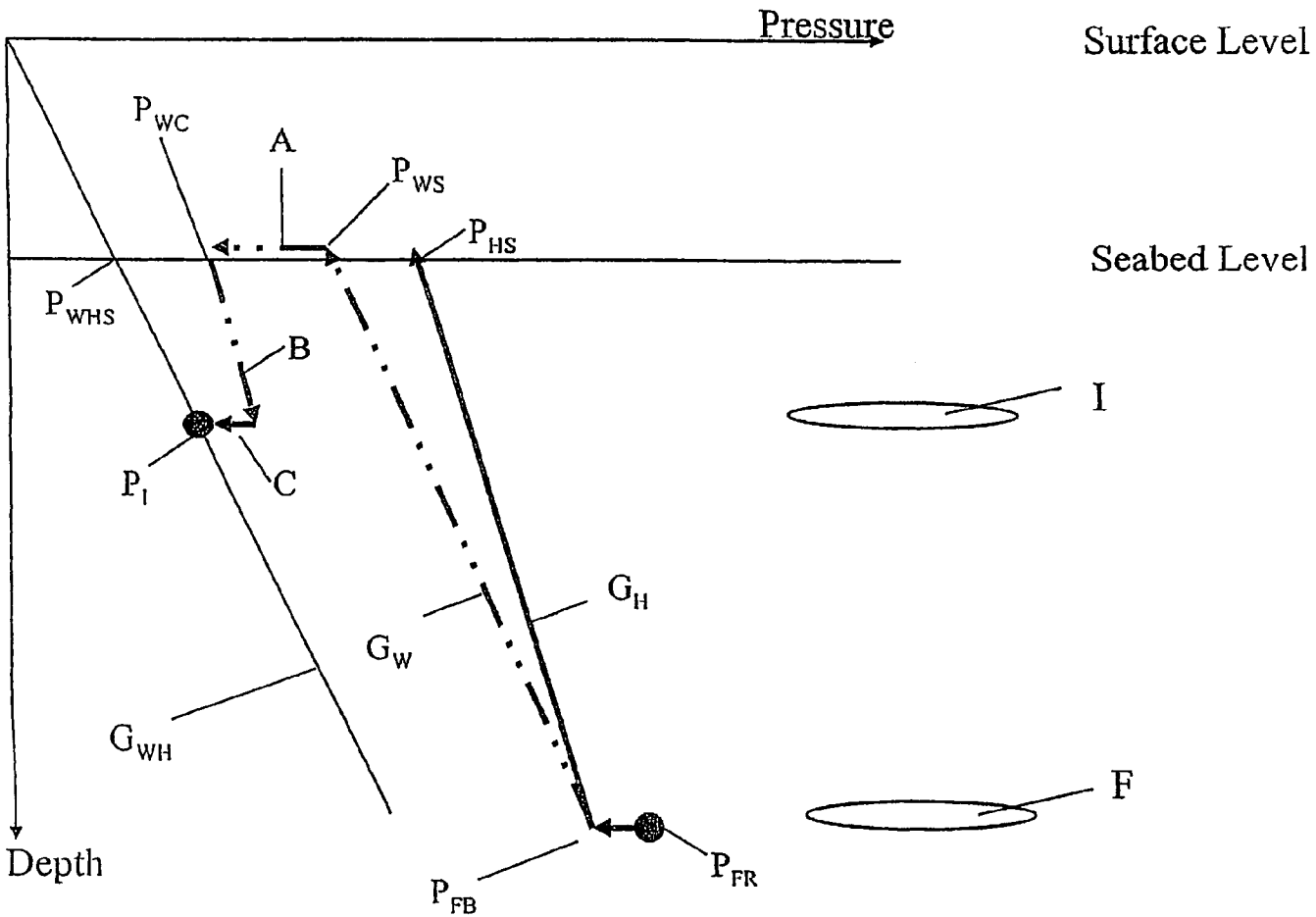
FIG. 5 shows a diagram of the pressure gradients for water from a relatively newly developed high pressure formation.

FIG. 5 shows a diagram of pressure gradients for water from a high pressure formation F, the reservoir pressure being denoted $P_{FR}$. $G_{WH}$ is the hydrostatic pressure gradient of water. Due to drawdown in the formation (mainly caused by flow resistance of the pores in the formation) the bottom hole pressure $P_{FB}$ is somewhat lower than $P_{FR}$ Near the bottom of the well the formation fluid is separated into a hydrocarbon phase and a water phase. The hydrocarbons are brought to the seabed along a pressure gradient $G_H$. The water is brought to the seabed along a pressure gradient $G_W$. As clearly shown in FIG. 5, the pressure gradient $G_H$ of the hydrocarbons is steeper than the pressure gradient $G_W$ of water, which is parallel to $G_{WH}$. Thus, the hydrocarbons will arrive at the seabed with a higher pressure $P_{HS}$ than the water pressure $P_{WS}$. The available pressure $P_{HS}$ may be used for transportation or for power takeout.

Even though the water arrives at the seabed with a lower pressure $P_{WS}$, the pressure of the water is substantially higher than the hydrostatic pressure $P_{WHS}$ at the seabed level.

The water is to be injected into an injection zone I, which has a pressure $P_I$, equal to the hydrostatic pressure of water at the same elevation. The water pressure $P_{WS}$ may be too high for injection directly. FIG. 5 show a choking of the water pressure along the arrow A to a pressure $P_{WC}$ which is subsequently used for injection. The arrow B illustrates the injection as the water pressure increases to a pressure $P_{WI}$. Due to the drawdown of the injection zone I, the pressure $P_{WI}$ will have to be higher than the injection zone pressure $P_I$. The arrow C illustrates the pressure decrease of the water as it penetrates the injection zone.

Figure 6:
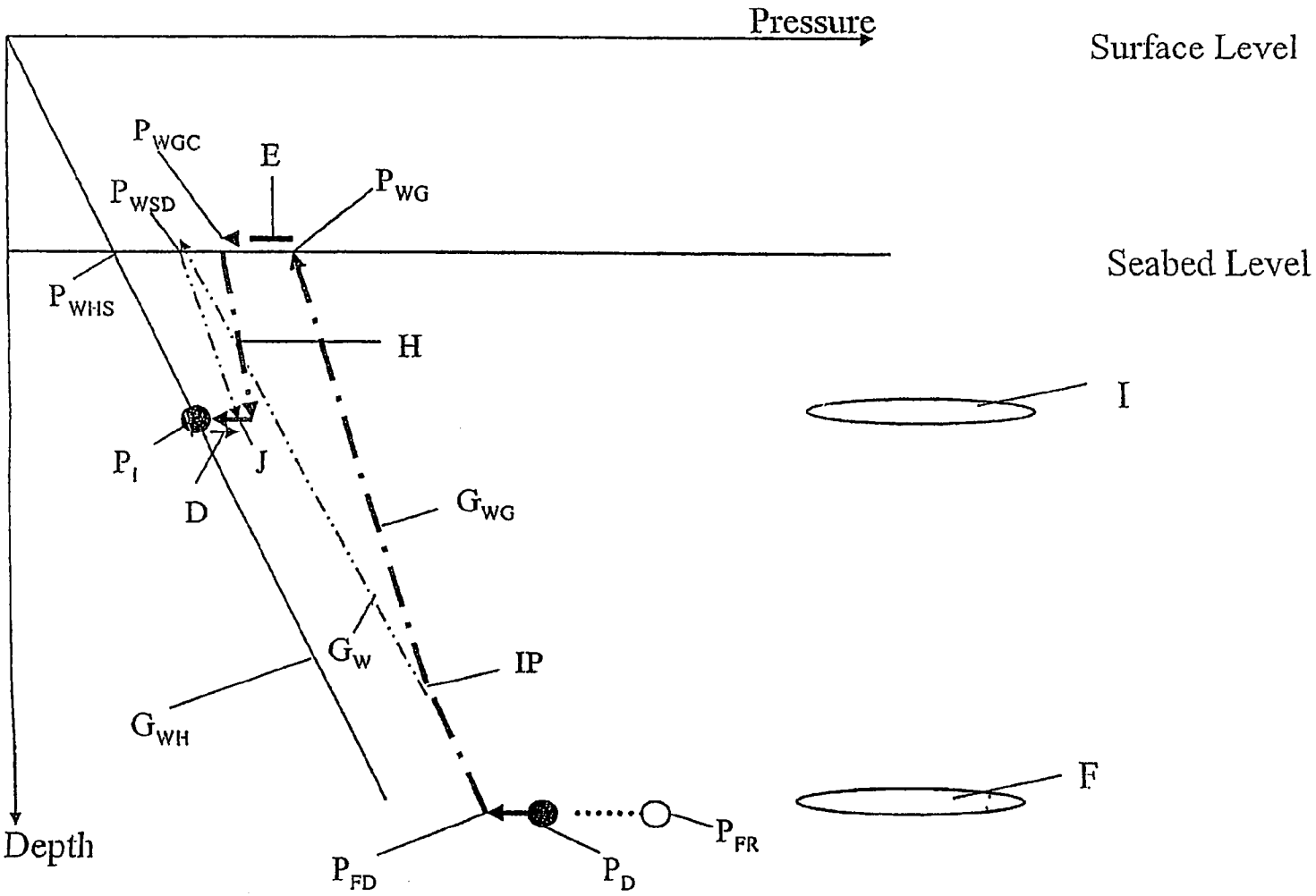
FIG. 6 shows a diagram of the pressure gradients for water from a depleted formation.

In FIG. 6 the formation F has lost a substantial part of the initial pressure $P_{FR}$, the depleted pressure is denoted $P_D$. Due to drawdown of the formation the bottom hole pressure is reduced to $P_{DB}$. The water gradient $G_W$ illustrates the situation of freeflowing water to the seabed. The resulting pressure $P_{WSD}$ at the seabed is substantially lower than the pressure $P_{WS}$ if the water at the seabed when the formation F was at initial pressure. The pressure $P_{WS}$ is too low for the water to be injected into the injection zone I. The arrow D shows a too low pressure difference.

The pressure gradient $G_{WG}$ illustrates the situation when gas is introduced to the water at an injection point IP downhole. This gradient $G_{WG}$ is much steeper than the hydrostatic gradient $G_{WH}$ of the water. The water is thus arriving at a pressure of $P_{WG}$ at the seabed. This pressure may be choked to a pressure $P_{WGC}$, which is suitable for injection, shown by the arrow E. The arrow H illustrates the injection into the injection zone I and the arrow J illustrates the drawdown of the injection zone.

Figure 1A:
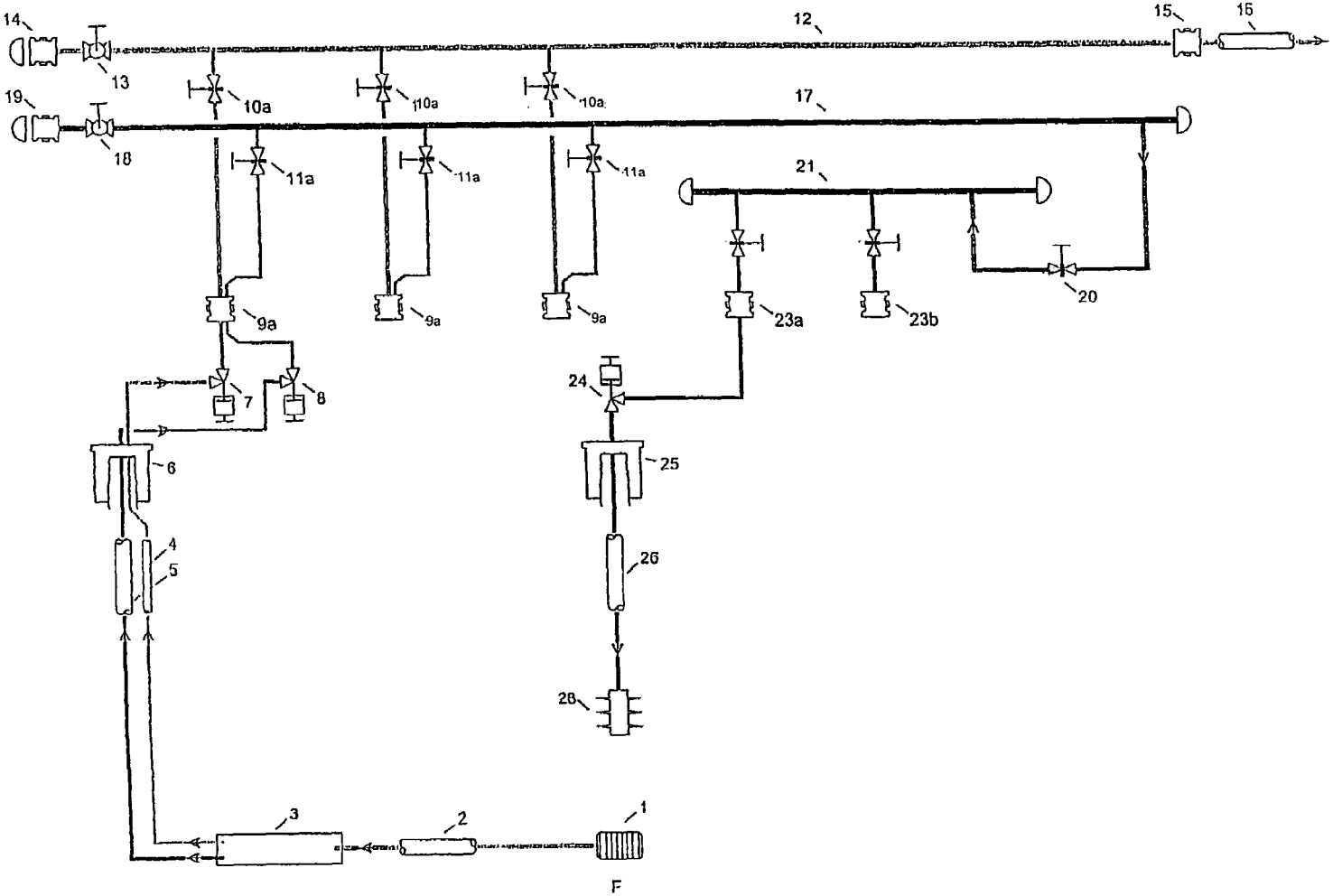
FIG. 1*a* illustrates a layout of downhole separation of fluid from an underground formation, transportation of hydrocarbons and water to a subsea manifold, and subsequent injection of water into another formation according to a first embodiment of the invention.

FIG. 1*a* illustrates a layout of a production manifold and well according to a first embodiment of the present invention. The layout illustrates production of fluid from an underground formation F and transportation of the fluid to the subsea manifold.

Hydrocarbons (oil and in some cases gas) mixed with water is emanating from the reservoir F flows via sand screens 1 into the well, and is transported in a tubing 2 to a downhole separator 3 where the water phase and hydrocarbon phase are separated. The separator 3 may be of gravity or centrifugal type. The water phase and hydrocarbons phase of the well fluid are transported to the wellhead 6 in separate flow channels 4, 5. Typically the hydrocarbons will be routed to a production tubing 4 whilst the water is routed to the annulus 5 formed between the production casing and the production tubing. Alternatively, in a dual completion system both phases will be brought to the seabed in individual production tubes.

Using a dual function x-mas tree 6 facilitates production and control of two discrete flows from the well to the a subsea manifold system. A choke valve 7 is provided after the x-mas tree 6 in the hydrocarbon flow line, and is used for controlling the well fluid production rate. A choke valve 8 is provided after the x-mas tree in the water flow line, and is used for controlling the rate of water extracted from the downhole separator 3.

Both fluid flows, hydrocarbons and water, are supplied to separate headers 12, 17 in the manifold via a mechanical multibore connector 9*a*. In the case the producing well is a satellite well rather than a well placed into a template, flowlines will connect the well to the manifold. The figure shows three producing wells connected to the manifold.

The hydrocarbon phase is routed into a first manifold header 12 via an isolation valve 10*a*. The header is illustrated with a connector 14 and a full bore isolation valve 13 allowing hook-up to another manifold and a connector 15 at the opposite end, connecting to a flow line 16 for transportation of the produced hydrocarbons to a host platform or another receiver.

Subsea processing such as multiphase pressure boosting and gas liquid separation may be incorporated into the described concept.

The water phase is routed into a second manifold header 17 via an isolation valve 11*a*. The header is illustrated with a connector 19 and a full bore isolation valve 18 allowing hook-up to another manifold.

The water from the production wells is routed via an insulation valve 20 to a third header 21 being in connection with one or several injection wells (only one leading into a reservoir 28 is fully shown). The injection header 21 is illustrated connected to two injection wells, located within a subsea template, by single bore connectors 23*a*, 23*b*. The connector 23*a* is shown connected to a choke valve 24, a wellhead 25, a tubing 26 and an underground zone or reservoir 28. The water is distributed to the wellhead 25 of the injection wells via the choke valve 24 and routed via the tubing or casing 26 to a suitable underground zone 28 for disposal.

Alternatively the formation 28 may be a hydrocarbon producing zone with a substantially lower pressure than the formation F, for sweep or for increasing the pressure in the formation 28, to increase the hydrocarbon output.

The feasibility of this concept requires that the producing reservoir F has a sufficiently high pressure to overcome pressure drop related to inflow losses from the producing formation F into the production well, dynamical friction losses along the flow path and outflow losses from the bottom of the injection well into the disposal formation.

It also requires that the pressure of the separated water at the seabed is sufficiently high to overcome the counterpressure from the formation 28, into which the water is to be injected. In case the pressure is not sufficiently high, a pump may be installed, which is to be explained below.

Figure 1B:
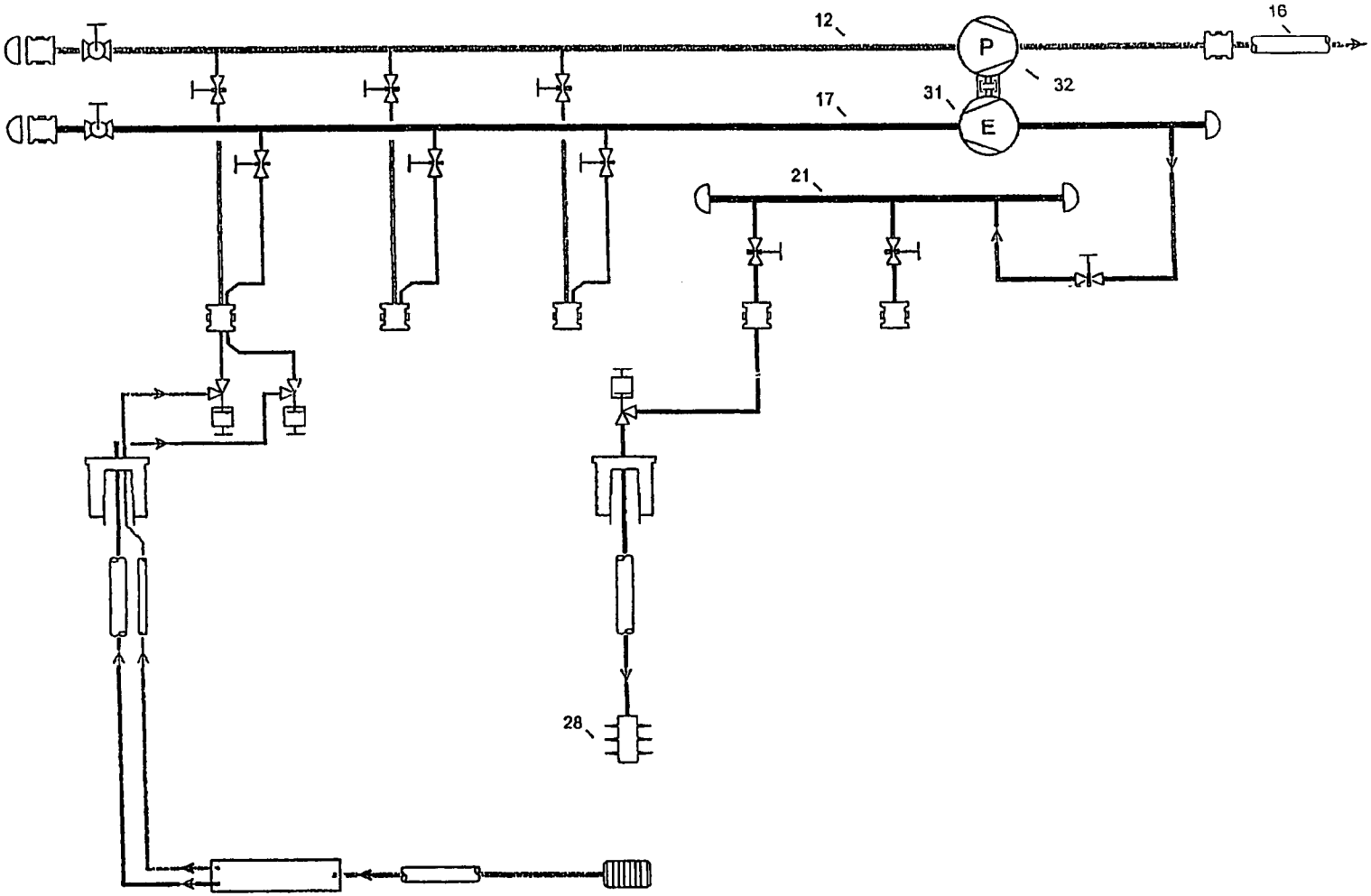
FIG. 1*b* illustrates a second embodiment of the present invention, which is a variation of the embodiment of FIG. 1, but in which a turbine/pump hydraulic converter is provided in the manifold.

FIG. 1*b* illustrates a layout of a production manifold and well according to a second embodiment of the present invention. The layout is similar to FIG. 1*a*, but with a turbine/pump hydraulic converter 31, 32 installed in the manifold. This layout is applicable for a production situation whereby the water phase at the seabed has a higher pressure than that which is required for injection. This available differential pressure may be utilized for pressure boosting the hydrocarbon phase.

The concept is shown with a turbine 31 installed in second header 17 and mechanically connected to a multiphase pump 32 installed into the first header 12. A by-pass and utility system is not shown, but may be present. The water flowing into the second header 17 is driving the turbine 31 into rotation, the rotation is transmitted via a shaft to the pump 32, which in turn is pressurising the hydrocarbons. This pressurising of the hydrocarbons will provide for a longer transport distance for the hydrocarbons before additional pumps must be provided, and/or a larger through-put of hydrocarbons.

In the case of separation of the hydrocarbons into a gas phase and a oil phase downhole or at the seabed, the turbine may alternatively drive a single phase pump or compressor to pressurise the oil flow or the gas flow.

After the pressurising of the hydrocarbons in the turbine/pump converter 31, 32, the water is led to the third header 21 and injected, as explained in connection with FIG. 1*a*. The turbine/pump converter 31, 32 must be carefully controlled so that not too much energy is taken out of the water. If this happens, it may prove difficult to inject the water against the counterpressure in the formation 28. To facilitate the control and regulation of the turbine/pump converter 31, 32, the turbine 31 and/or the pump 32 may have variable displacement. A pressure sensor (not shown) may advantageously be installed in the second header 17 after the turbine 32 to control the pressure of the water and adjust the turbine/pump converter 31, 32 according to this pressure.

A deep reservoir producing a light condensate will most likely have higher pressure at the seabed than what is required for natural flow to the receiver (i.e. host platform, floater etc.). Therefore, as an alternative to providing a turbine in the second header 17, transporting water, and a pump 32 in the first header 12, transporting hydrocarbons, the turbine may be provided in the first header 12 and the pump in the second header 17. In this case a turbine in the hydrocarbon flow can provide required energy for re-injecting the produced water into the producing reservoir, or formation 28 suitable for disposal. This is especially advantageously if the water has a too low pressure for injection and needs to be pressurized.

Figure 1C:
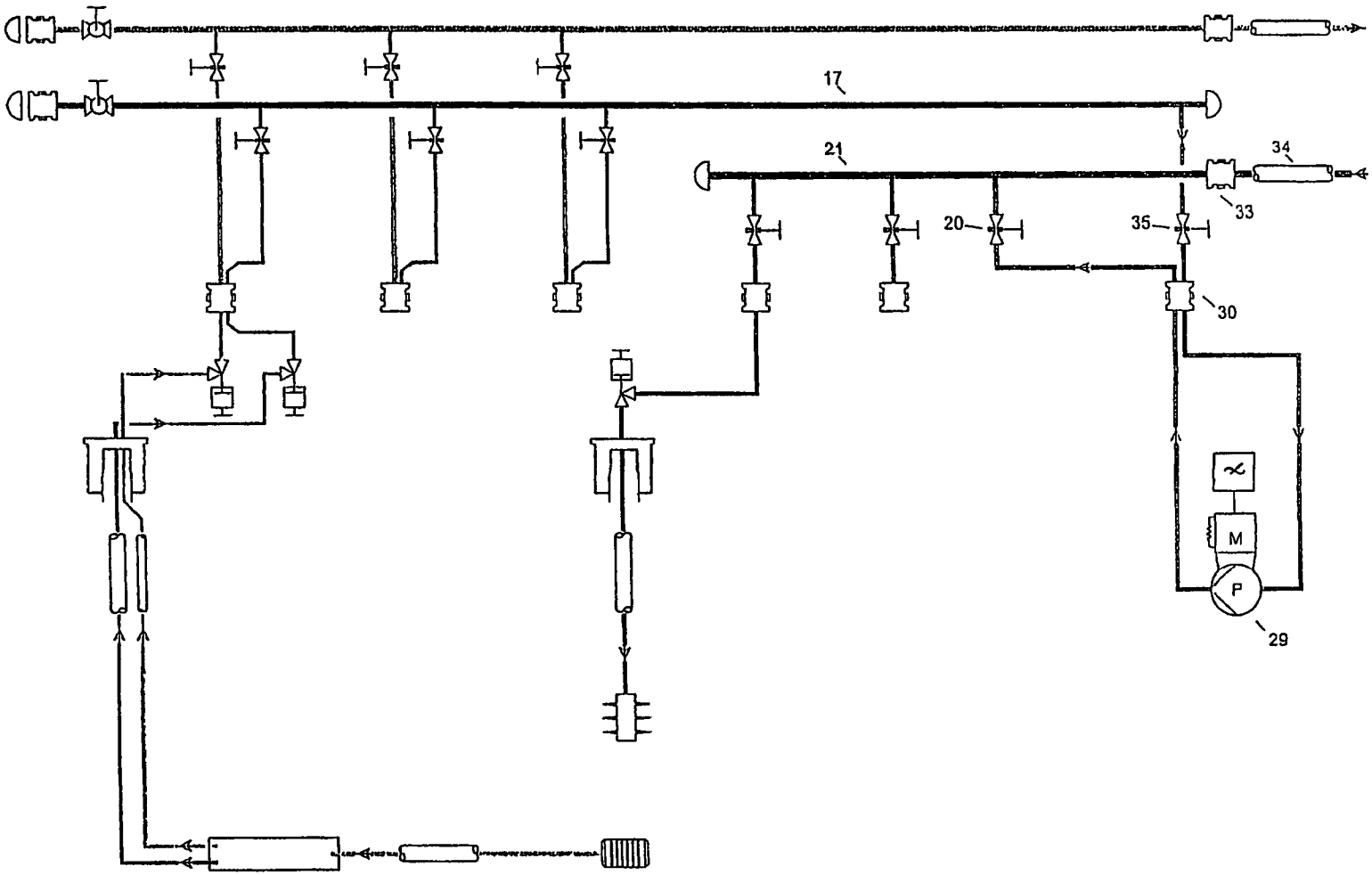
FIG. 1*c* illustrates a third embodiment of the present invention, which is a variation of the embodiment of FIG. 1*a*, in which an electric pump is provided for pressurising the water.

FIG. 1*c* illustrates a layout of a production manifold and well according to a third embodiment of the present invention. The layout is similar to FIG. 1*a*, but with the implementation of a retrievable speed controlled water injection pump 29 connected to the third header 21 of the subsea manifold by a multibore connector 30. The pump 29 is illustrated without details such as utility systems, recycling arrangement and pressure equalizing valves. The produced water is fed from the second header 17, pressurized in pump 29 and discharged into the header 21 for re-injection. In addition a flowline 34 supplying additional water for re-injection may be present as shown connected to the third header 21 via a connector 33. The isolation valves 20, 35 facilitate retrieval of the injection pump.

The feasibility of this concept requires that the water phase can be brought from the formation to the suction side of the pump 29 with a net positive suction head in excess of what is required to avoid cavitation. At high water depths the outlined concept is likely to be physically possible even though the producing reservoir is depleted far below initial or even below hydrostatic pressure.

Figure 2A:
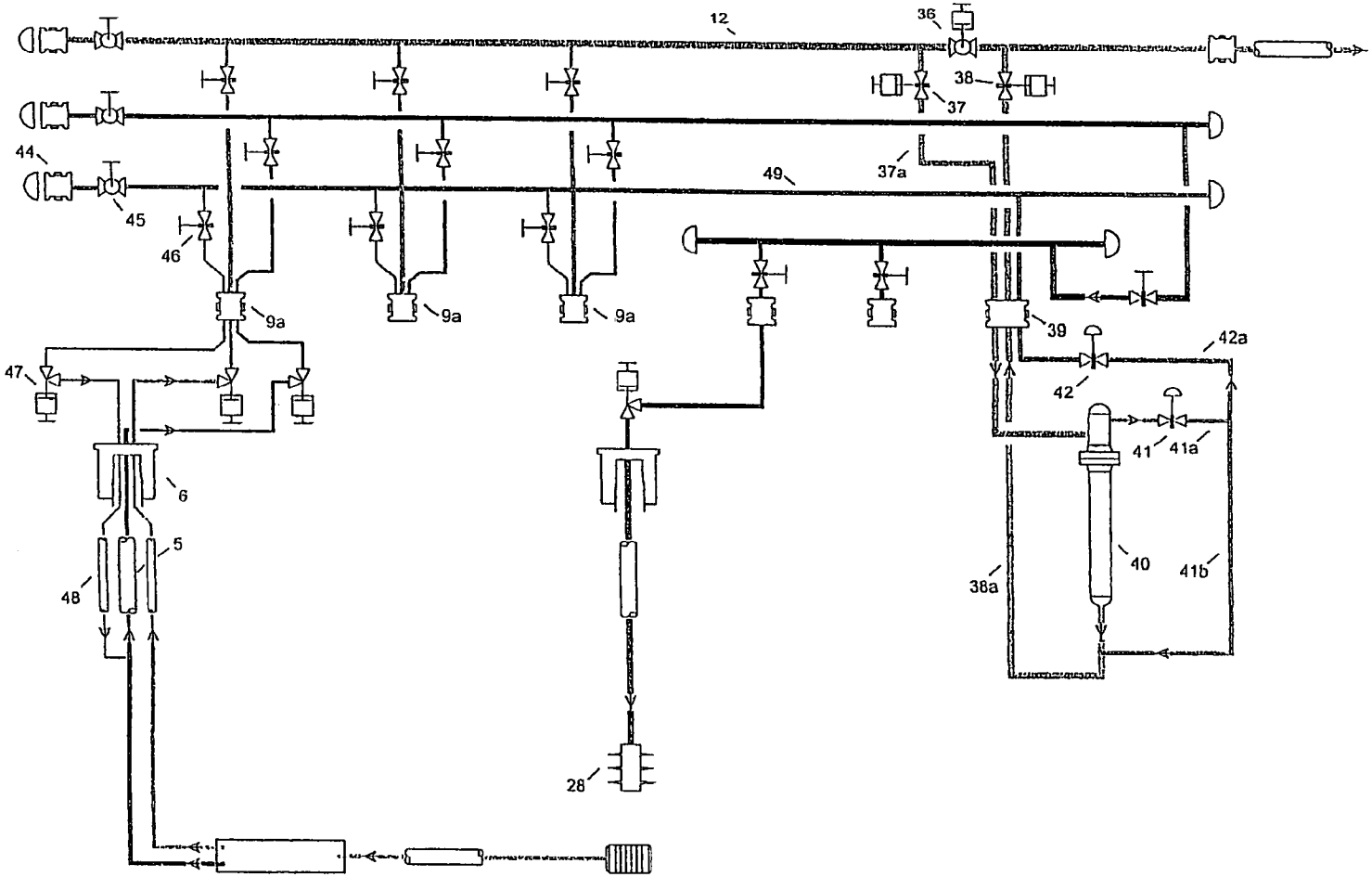
FIG. 2*a* illustrates a layout of downhole separation of fluid from an underground formation, transportation of hydrocarbons and water to a subsea manifold, and subsequent injection of water into another formation, using gas lift of the water according to a fourth embodiment of the invention.

FIG. 2*a* illustrates a layout of a production manifold and well according to a fourth embodiment of the present invention. The layout is similar to FIG. 1*a*, with an addition of a fourth header 49 and a gas-liquid separator 40. The layout of FIG. 2*a* is applicable in a production situation where artificial lift is utilized for producing the water phase to the seabed with a sufficient high pressure for allowing the water to be routed into the injection well(s) without pressure increase at the seabed.

A branch line 37*a* with an isolation valve 37 is connected to the first header 12. The branch line 37 is further connected to a gas-liquid separator 40. From the gas-liquid separator 40 a gas outlet line 41*a* and a liquid outlet line 38*a* are extending. The gas outlet line 41*a* is branching into a gas return line 41*b* and a gas supply line 42*a*, which is connected to a fourth header 49 through a control valve 42. The gas return line 41*b* is connected to the liquid outlet line 38*a*. The liquid outlet line 38*a* is further connected to the first header 12 via an isolation valve 38. In the first header 12, between the branch line 37*a* and the liquid return line a by-pass valve 36 is provided.

The fourth header 49 is further connected to the x-mas tree 6 via an isolation valve 46, the multibore connector 9*a* and a choke valve 47. From the x-mas tree 6 the gas is fed through a tubing 48 and into the water pipeline 5.

Gas for lift is extracted from the produced hydrocarbon phase. Fluid from the header 12 is routed to the retrievable gas-liquid separator 40 via the multibore mechanical connector 39 by opening the isolation valve 37 and closing the by-pass valve 36. A control valve 41 regulated the rate of gas extracted from the separator 40 with the objective of maintaining a suitable gas-liquid interface level within the separator 40. A control valve 42 is adjusted for a suitable rate of gas to be fed to the gas injection header (fourth header) 49. The surplus gas is fed into the gas return line 41*b*, commingled with the liquid from the separator 40 and returned to the hydrocarbon header (first header) 12 via the isolation valve 38. The gas injection header (fourth header) 49 is shown provided with a connector 44 and an isolation valve 45 at one end. This facilitates a connection of the fourth header to other manifolds or further wells.

Gas from the fourth header 49 is routed to the production x-mas tree 6, and to the wells connected to connectors 9*b* and 9*c*. A suitable rate is regulated by a choke valve 47. The depth of the injection point where gas is commingled with the water is chosen with respect to available gas pressure. Because of the added gas, which has a substantial lower density than the water, the overall bulk density of the column is reduced and the commingled water/gas flow will arrive at the wellhead with a higher pressure than the water would have had without gas lift. In addition the gas will expand as the pressure is decreasing during the travel to the well head, resulting in a further decrease of the density, and thus a further decrease in pressure drop. The gas utilized for lift will follow the water phase into the second header and third header, and is in this discharged into the injection wells and the formation 28.

This production concept is illustrated with the total produced hydrocarbon flow. In alternative configurations a split flow or production from a single well may be used to provide gas for artificial lift of the water.

Figure 2B:
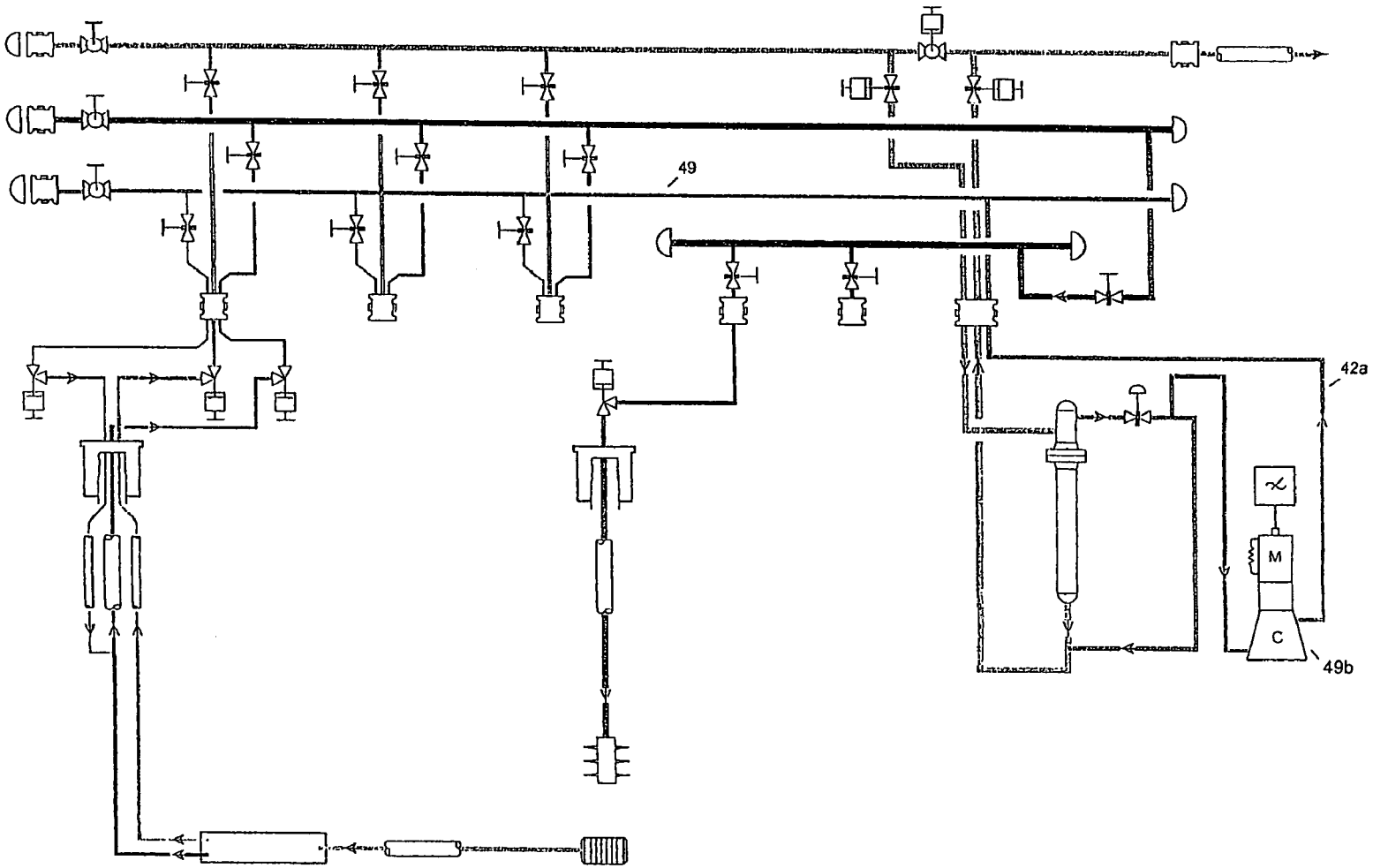
FIG. 2*b* illustrates a fifth embodiment of the invention, which is a variation of FIG. 2*a*, in which an electric compressor is provided to pressurise the gas.

FIG. 2*b* illustrates a similar layout to FIG. 2*a*, but comprises in a fifth embodiment also an electric compressor 49*b* to pressurise the gas to improve lift capabilities. The compressor can be of centrifugal or positive displacement type. The compressor 49*b* is coupled into the gas supply line 42*a*. Although some valves shown in FIG. 2*a* are omitted in FIG. 2*b*, these valves may be present in an actual design.

Figure 3A:
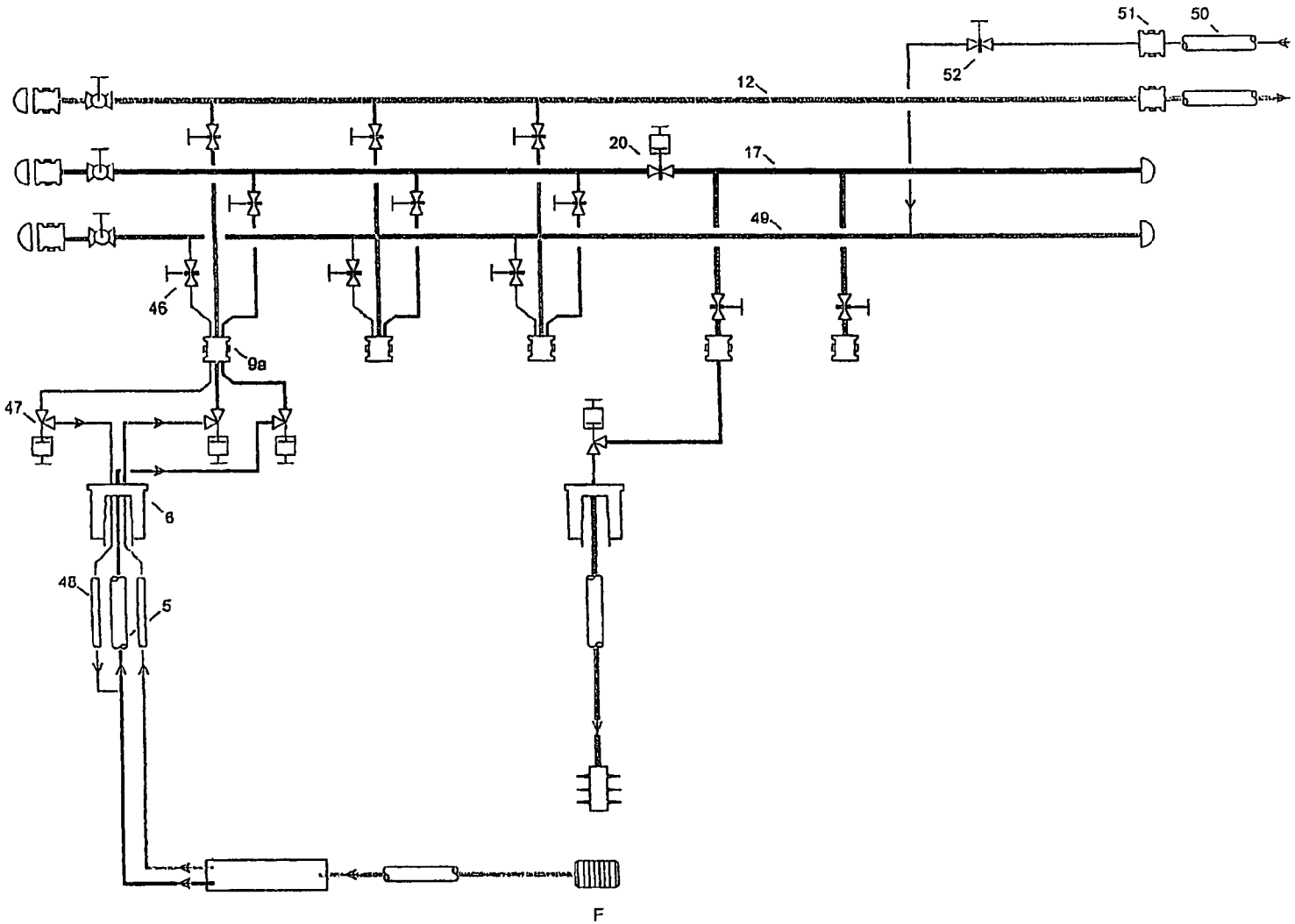
FIG. 3*a* illustrates a layout of downhole separation of fluid from an underground formation, transportation of hydrocarbons and water to a subsea manifold, and subsequent injection of water into another formation, using gas lift of the water with gas supplied from a distant source, according to a sixth embodiment of the invention.

FIG. 3*a* illustrates a layout of a production manifold and well according to a sixth embodiment of the present invention. FIG. 3*a* illustrates the concept of using gas for artificial lift of the water produced from the formation F and supplied to the subsea.

The manifold comprises in addition to the first header 12 and second header 17, an additional header 49, which corresponds to the fourth header in the embodiments of FIGS. 2*a* and 2*b*, and thus is called the fourth header also with respect to the present embodiment. The fourth header is in communication with the x-mas tree 6 via the isolation valve 46, the multibore connector 9*a* and the choke valve 47, in the same way as illustrated in FIGS. 2*a* and 2*b*. From the x-mas tree the fourth header is further communicating with a gas tubing 48, which is connected to the water tubing 5, this also in the same way as in FIGS. 2*a* and 2*b*.

The header is also connected to a gas supply line 50 via a connector 51 and an isolation valve 52. The gas supply line may be a service umbilical.

The gas supply line 50 is supplying gas from a distant source, e.g. a gas producing well, which is fed into the fourth header 49 via the connector 51 and the isolation valve 52 and further into the water tubing 5 via the isolation valve 46, the connector 9*a*, the choke valve 47, the x-mas tree 6 and the gas tubing 48.

In comparing the layout of FIG. 3*a* with the layout of, e.g. FIG. 2*b*, it is also evident that the second and the third headers are combined into one header divided by an isolation valve 20. This configuration is completely equivalent with the configuration of FIG. 2*b*.

In other respects the embodiment of FIG. 3*a* is functioning the same way as in FIGS. 2*a* and 2*b*.

Figure 3B:
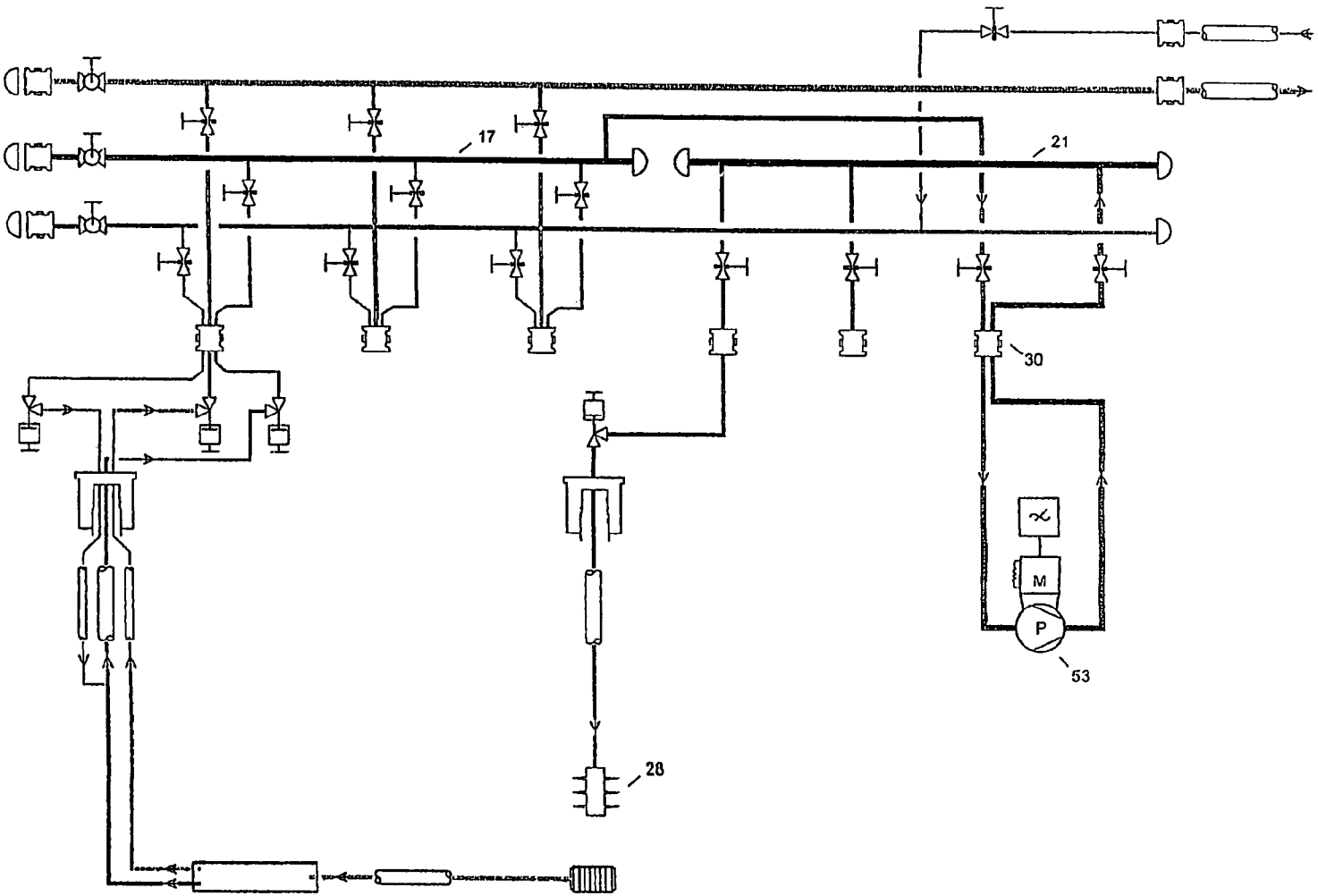
FIG. 3*b* illustrates a seventh embodiment of the present invention, which is a variation of FIG. 3*a*, in which the water is also pressurised by an electric pump before injection.

FIG. 3*b* is illustrating a layout of a seventh embodiment of the present invention, which is similar to the embodiment of FIG. 3*a*, but with an addition of an electric water pump 53 for pressurising water for injection. The pump 53 is coupled into the connection between the second header 17 and the third header 21.

The produced water with gas used for artificial lift can be re-injected by use of the subsea speed controlled multiphase pump 53. The pump is shown retrievable and integrated into the subsea manifold between the produced water header 17 and the water injection header 21 by a mechanical connector 30.

This embodiment is applicable when the pressure inherent in the water at the seabed and the lift created by the gas insertion are not enough to inject the water into the formation 28 against the counter pressure in this formation. The pump 53 will create the extra pressure needed.

Figure 4A:
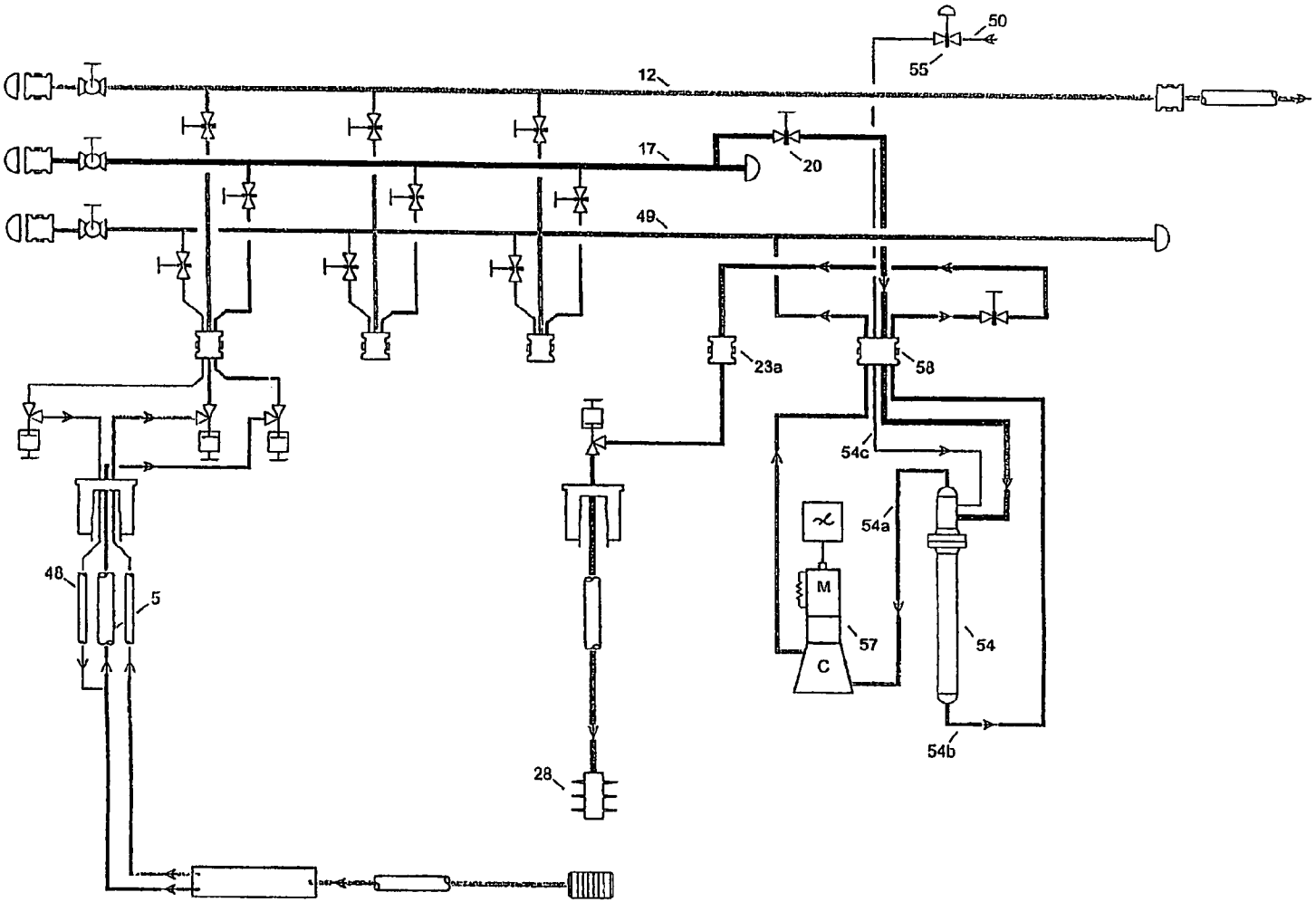
FIG. 4*a* illustrates a layout of downhole separation of fluid from an underground formation, transportation of hydrocarbons and water to a subsea manifold, and subsequent injection of water into another formation, using gas lift of the water, with gas in a closed circuit and de-gassing of the water, according to an eighth embodiment of the invention.

FIG. 4*a* illustrates a layout of an eighth embodiment, which in some respects is similar to the embodiment of FIG. 2*b*. However, in this embodiment the gas is separated from the water.

The embodiment of FIG. 4*a* comprises a first header 12 for conducting hydrocarbons, a second header 17 for conducting water from the formation F and a fourth header 49 for conducting gas for gas lift. A third header is not illustrated, but may be present as appropriate.

The second header is connected to a gas-liquid separator 54 via an isolation valve 20 and a connector 58. The gas-liquid separator 54 has a gas outlet line 54*a*, a liquid outlet line 54*b* and a gas supplement line 54*c*. The gas outlet line is connected to the fourth header via a compressor 57. The liquid outlet line is connected to the connector 23*a* and from this to the well leading into the formation 28. The gas supplement line is connected to a gas supply line 50 via an isolation valve 55.

FIG. 4*a* illustrates the concept of de-gassing the produced water at the seabed and re-cycling the gas for artificial lift of the produced water. The produced water containing the gas lift gas is routed from the second header 17 to the gas-liquid separator 54 via the multibore connector 58. The gas extracted from the separator 54 is pressurized in the compressor 57 and discharged into the fourth header (gas lift header) 49 via the connector 58, and further distributed to the producing wells, and as illustrated into the water tubing 5 via the gas tubing 48. The de-gassed water is fed via the liquid outlet line 54*b* and the connectors 58 and 23*a* to the water injection well and the formation 28. The gas regained from the water is again fed into the fourth header 49. The separator 54 and compressor 57 with interconnecting piping is shown as a retrievable unit.

For make-up and for initial start-up gas may be supplied via the gas supply line by opening the isolation valve 55. The line 50 may be a service umbilical line leading from a distant source or a line leading from a de-gasser (not shown), extracting gas from the produced hydrocarbons.

In case some of the gas is lost during this process, or in case more gas than needed is retrieved from the water, gas may be supplied or withdrawn from the gas supply line 50 by opening the isolation valve 55.

The water may also optionally be discharged to the surrounding sea, instead of or supplemental to disposal in an underground formation, provided it has sufficient pressure, and that de-oiling cyclones are utilized to meet required oil-in-water entrainment requirement.

Figure 4B:
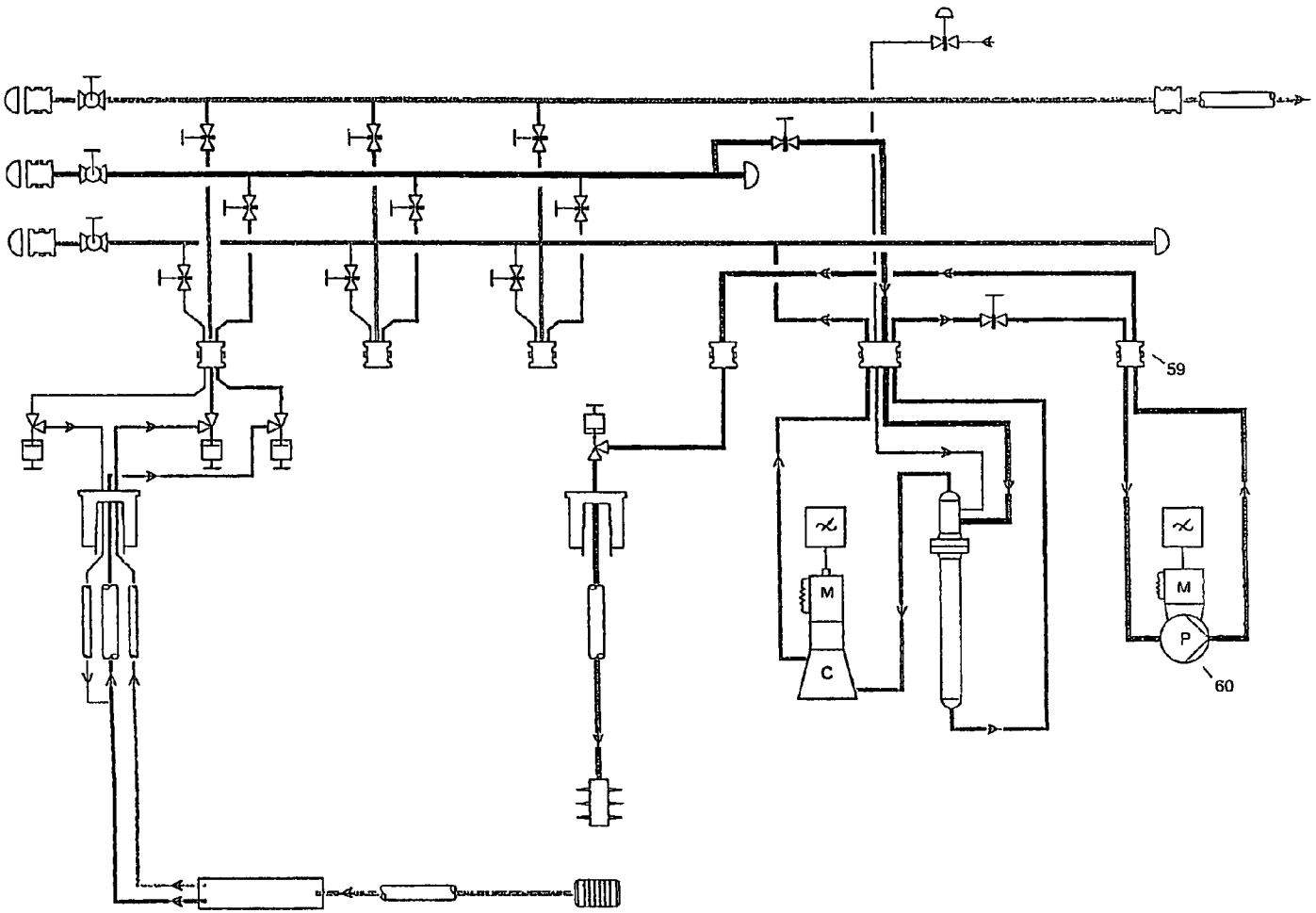
FIG. 4*b* illustrates a ninth embodiment of the present invention, which is a variation of FIG. 4*a*, in which an electric pump is provided for pressurising the water before injection.

FIG. 4*b* illustrated in a ninth embodiment a similar concept as described in FIG. 4*a*, with the addition of a single phase water injection pump 60 integrated into the subsea manifold by a multibore connector 59. This pump 60 has the same function as the pump 53 of the embodiment in FIG. 3*b*. i.e. to boost the pressure of the water before injection if the pressure on the suction side of the pump is too low for the water to be injected by its inherent pressure.

All the described production alternatives can be enhanced as required to include subsea processing equipment for gas-liquid separation, further hydrocarbon-water separation by use of electrostatic coalescing, single phase liquid pumping, single phase gas compression and multiphase pumping. In case of subsea gas-liquid separation, gas may be routed to one flowline whilst the liquid is routed to the other. Any connector may be of horizontal or vertical type. Return and supply lines may be routed through a common multibore connector or be distributed using independent connectors. As an alternative to inject the water into a different well than the production well, the water may be injected into the production well and disposed of in a formation at a higher elevation, with low pressure.

Instead of injecting the water into a formation, the water may, according to regulations, purity of the water, environmental conditions and available polishing equipment, be disposed of to seawater. To be able to do this the water must be de-gassed and optionally polished to remove environmentally hazardous compounds.

Choke valves may be located on the x-mas tree as shown in attached figures, but can also be located on the manifold. The valves may if required be independent retrievable items. Subsea choke valves are normally hydraulic operated but may be electrical operated for application where a quick response is needed.

Electrically operated pumps are not illustrated in attached figures with utility systems for re-cycling, pressure compensation and refill. One pump only is shown for each functional requirement. However, depending on flowrates, pressure increase or power arrangement with several pumps connected in parallel or series may be appropriate.

The present invention also provides for any working combination of the embodiments shown herein. The invention is limited only by the enclosed claims and equivalents thereof.

The invention claimed is:

1. A method of producing reservoir fluid from a hydrocarbon containing underground reservoir, comprising the following steps:

in an oil well comprising a subsea wellhead and wellbore extending into a subsea underground reservoir, said subsea well connected to a flowline to the sea surface;

separating reservoir fluid downhole in said wellbore into at least a hydrocarbon phase and a water phase, bringing the hydrocarbon phase and the water phase separately to said subsea wellhead after being separated, injecting said water phase into another wellbore through an associated second subsea wellhead and utilizing at least partly the pressure in said water phase.

2. The method according to claim 1, wherein the water phase is free-flowing from the production wellhead into said another wellbore.

3. The method according to claim 1, wherein the water phase is pressurized by a pump located at the seabed before being injected into said another wellbore.

4. The method according to claim 1 of producing reservoir fluid from a hydrocarbon containing underground reservoir, comprising the following steps:

utilizing at least partly the pressure in at least one of the said phases to power at least one component located at the seafloor chosen from the group of components consisting of turbines, pumps, compressors and separators.

5. The method according to claim 4, wherein energy from the water phase is utilized in at least one turbine which in turn powers at least one pump, wherein said pump boosts the pressure of the hydrocarbon phase.

6. The method according to claim 4, wherein said hydrocarbon phase powers at least one turbine, which in turn powers at least one pump, and said pump boosts the pressure of said water phase before injection of said water phase into another wellbore.

7. The method according to claim 4, wherein pressure from said water phase powers a compressor which in turn pressurizes gas.

8. The method according to claim 4, wherein pressure from said water phase powers at least one gas-liquid separator.

9. The method according to claim 8, further comprising the steps of degassing said water phase, and disposing of said water phase to seawater.

10. The method of claim 1 of producing reservoir fluid from a hydrocarbon containing underground reservoir comprising:

leading said hydrocarbon phase through a first control valve;

leading said water phase through a second control valve; said first and second control valves being located at seabed, measuring at least one of parameter chosen from the group of parameters consisting of:

a separator interface level, a flow-split, a differential pressure across said separator and a phase purity; and regulating at least one of said control valves as a function of said at least one parameter to increase or decrease the flow rate of hydrocarbons or water from said separator, to maintain said at least one parameter within predefined limits.

11. A method of producing reservoir fluid from a subsea, hydrocarbon containing underground reservoir, comprising the following steps:

in an oil well comprising a subsea wellhead and wellbore extending into a subsea underground reservoir, said subsea wellhead connected to a flowline to the sea surface;

separating reservoir fluid downhole in said wellbore into at least a hydrocarbon phase and a water phase, bringing the hydrocarbon phase and the water phase separately to said subsea wellhead after being separated, using a gas phase for artificial lift of said water phase to said first subsea wellhead, injecting said water phase into another wellbore through an associated second subsea wellhead and utilizing at least partly the inherent pressure in said water phase.

12. The method of producing reservoir fluid of claim 11, said using gas for artificial lift of said water phase comprising:

providing a gas phase with a higher pressure than said water phase at a downhole injection level; and injecting said gas phase into said water phase at said injection level, thereby using said gas phase for artificial lift of said water phase.

13. The method according to claim 12, wherein said gas phase for artificial lift is provided by separation of gases from said hydrocarbon phase in a subsea separator.

14. The method according to claim 13, farther comprising compressing said gas phase before said gas phase is injected into said water phase.

15. The method according to claim 12, wherein said gas phase for artificial lift is provided by separating said gas phase from said water phase at the seabed.

16. The method according to claim 11, wherein said gas phase for artificial lift is supplied from a distant source.

17. The method according to claim 11, farther comprising injecting said water phase together with said gas phase used for artificial lift into said another wellbore and hence into an underground formation.

18. The method of producing reservoir fluid according to claim 12, said injecting said water phase into another wellbore comprising pressurizing said water phase with a pump.

19. A system for producing reservoir fluid from a subsea, hydrocarbon containing underground reservoir, comprising:

a subsea wellhead and wellbore extending into a subsea underground reservoir;

a flowline connecting said wellhead to the seasurface;

a hydrocarbon-water separator located downhole in said wellbore and having at least one hydrocarbon outlet for hydrocarbon and at least one water outlet for water, each coupled to said wellhead and hense to a respective hydrocarbon line and water line; and a subsea means for injection of said water through said water line into another associated wellbore coupled to the wellhead.

20. The system according to claim 19, further comprising a pump coupled to said subsea means for injection, for pressurizing said water before injection of said water into said associated wellbore.

21. The system according to claim 19, wherein said water line is coupled to a turbine, and said hydrocarbon line is coupled to a pump, said turbine being coupled to said pump.

22. The system according to claim 19, wherein said water line is coupled to a pump, said hydrocarbon line is coupled to a turbine, and said the turbine is coupled to said pump.

23. The system according to claim 19, wherein said water line is coupled to a turbine, and said turbine is coupled to a compressor for pressuring gas.

24. The system according to claim 19, wherein said water line is coupled to a separator configured to degas said water.

25. The system for producing reservoir fluid according to claim 19, comprising:

a hydrocarbon tubing between said hydrocarbon outlet and said wellhead;

a water tubing between said water outlet and said wellhead;

first and second control valves disposed at said wellhead; said hydrocarbon tubing being coupled to said first control valve, said water tubing being coupled to said second control valve;

a measuring means for measuring at least one parameter chosen from the group of parameters consisting of: separator interface level, flow-split, differential pressure across the separator and phase purity;

a regulating means for regulating said first and/or said second control valves to control a flow rate from said separator, to maintain said at least one parameter within predefined limits.

26. A system for producing reservoir fluid from a subsea, hydrocarbon containing underground reservoir, comprising:

a downhole hydrocarbon-water separator in a subsea wellbore;

a subsea wellhead;

a hydrocarbon tubing between said separator and said wellhead;

a water tubing between said separator and said wellhead;

a hydrocarbon line coupled to said hydrocarbon tubing at said wellhead;

a water line coupled to said water tubing at said wellhead;

a gas line coupled to a gas tubing at said wellhead, and said gas tubing being coupled to the water tubing at a downhole injection point, for injection of gas to achieve artificial lift of water;

said water line coupled to an associated wellhead and wellbore.

27. The system according to claim 26, further comprising an additional separator coupled to said hydrocarbon line for separating gas from hydrocarbons.

28. The system according to claim 26, further comprising an additional separator coupled to said water line, for separating gas from the water.

29. The system according to claim 28, further comprising a compressor coupled to said gas line, for compressing said gas.

30. The system according to claim 26, further comprising a gas supply line coupled to said gas line.

* * * * *